US006986218B1

(12) United States Patent
Choy et al.

(10) Patent No.: US 6,986,218 B1
(45) Date of Patent: Jan. 17, 2006

(54) METHOD OF CONNECTING A HOUSING PART AND WATER TANK PARTS OF AN IRON

(75) Inventors: Kam W. Choy, Singapore (SG); Siew C. Yeo, Singapore (SG)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/314,416

(22) Filed: May 18, 1999

(30) Foreign Application Priority Data

May 20, 1998 (SG) ..... 9801085

(51) Int. Cl.
*D06F 75/36* (2006.01)

(52) U.S. Cl. ..... 38/88

(58) Field of Classification Search ..... 38/88, 38/77.8, 77.83; 156/272.2, 304.1, 304.6, 156/359, 379.6, 380.9
See application file for complete search history.

(56) References Cited

U.S. PATENT DOCUMENTS 3,038,269 A * 6/1962 Knapp ..... 38/77.8 X
4,115,935 A * 9/1978 Toft ..... 38/88
4,651,453 A * 3/1987 Doyle ..... 38/77.8
5,623,775 A * 4/1997 Farrington et al. ..... 38/88
5,630,287 A * 5/1997 Shimosaka et al. ..... 38/77.3
6,036,795 A * 3/2000 Sauron et al. ..... 156/304.6 X

OTHER PUBLICATIONS

"Calor Aquagliss 200".

"Machine Design" Nov. 13, 1996, pp. 40–48.

* cited by examiner

*Primary Examiner*—Ismael Izaguirre
(74) *Attorney, Agent, or Firm*—Ernestine C. Bartlett

(57) ABSTRACT

The invention relates to a method of connecting a housing part (1) of an iron to a water tank (2) of the iron. The water tank (2) comprises a top part (3) and a bottom part (4). The method includes a watertight connection between these top and bottom parts. To make a simple and inexpensive connection between the housing part (10) and the water tank parts (3, 4) an edge (15) of the housing part (1), an edge (10) of the top part (3) of the water tank (2) and an edge (8) of the bottom part (4) of the water tank (2) are connected to each other in a single process step by means of mirror welding.

1 Claim, 2 Drawing Sheets

METHOD OF CONNECTING A HOUSING PART AND WATER TANK PARTS OF AN IRON

Figure 1:
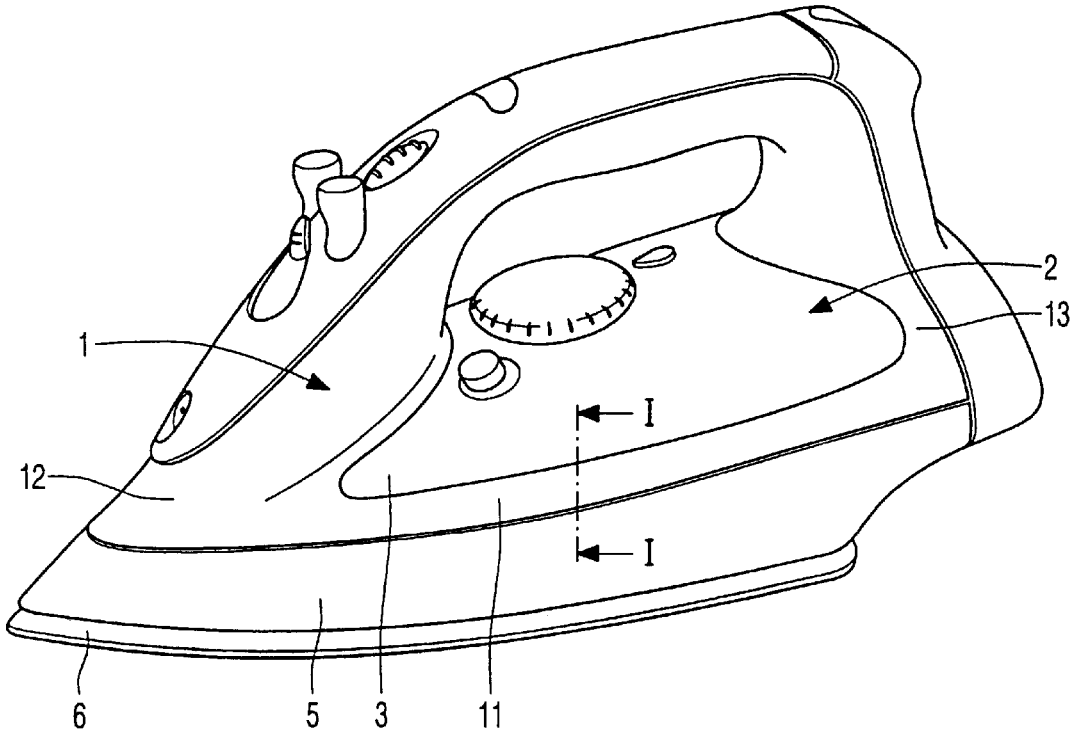

The invention relates to a method of connecting a housing part of an iron to a water tank of the iron, said water tank comprising a top part and a bottom part, and the method including a watertight connection between a peripheral edge of the top part and a peripheral edge of the bottom part of the water tank and a connection between an edge of the housing part and the water tank.

Such a method is known from an iron marketed under the trade name Calor Aquagliss 200. In this known method, first the top part of the water tank is moulded. This top part remains in the mould and subsequently the housing part is moulded so as to obtain an intimate connection between the matching parts. The matching parts are an edge of the housing part and an edge of the top part. This method is called 'double shot moulding'. Then, in another process step, the peripheral edge of the top part is sealed to a peripheral edge of a bottom part of the water tank. This means that the method of interconnecting these parts comprises two process steps: in the first step two parts are moulded together and in the second step the third part is sealed to the other two parts. The two process steps make the iron more expensive.

An object of the invention is to find a simple and inexpensive method of interconnecting a housing part, a top part and a bottom part of the water tank of an iron.

According to the invention, the method is characterized in that the edge of the housing part, the edge of the top part of the water tank and the edge of the bottom part of the water tank are connected to each other in a single process step by means of mirror welding.

Mirror welding, also referred to as fusion bonding, is a known method of interconnecting plastic parts. Often plastic parts are too complex to be fabricated by means of available moulding equipment. Therefore, a number of plastic sub-parts are moulded first and then welded to form an integral structure by fusion bonding. The sub-parts are introduced into holding devices to support said sub-parts. To plasticize the edges of opposite parts, the holding devices press these edges against a heating platen until the edges are plasticized to a predetermined depth. The holding devices open and the heating platen is withdrawn subsequently, the holding devices close again, forcing the two edges together under pressure, and allowing the melted material to cool and bond together. This method is described e.g. in Machine Design/Nov. 13, 1986, p. 40–48, under the heading 'Joining Plastic'. In the case of the above-described iron, the edges of the housing parts and both water tank parts are bonded together in a single manufacturing step. The result is a strong complex part, even if a sub-part is weak and flexible.

These and other aspects of the invention will be apparent and elucidated with reference to the embodiments described hereinafter.

Figure 2:
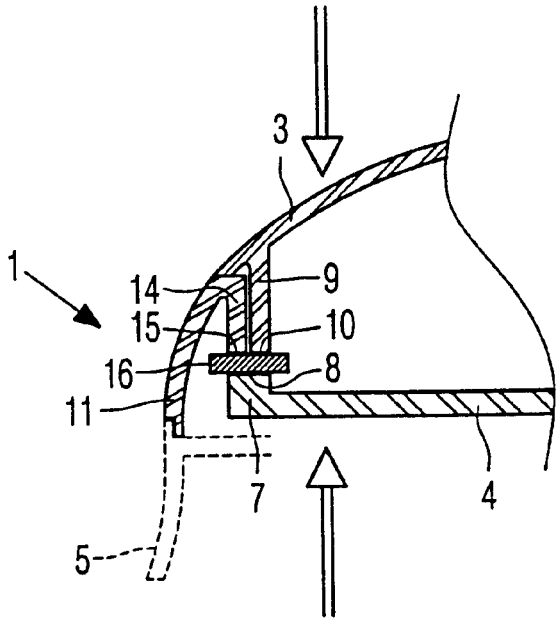
Figure 3:
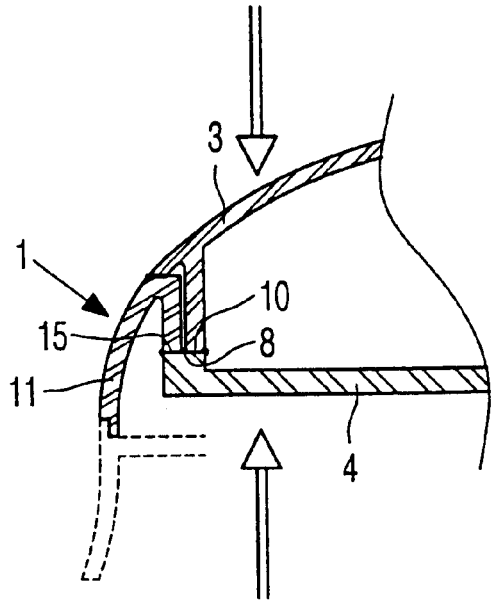

In the drawings:

FIG. 1 is a perspective view of an iron in which the method in accordance with the invention is used, FIG. 2 is a cross-sectional view, taken on the line I—I of FIG. 1 during the welding process, and FIG. 3 is a cross-sectional view, taken on the line I—I of FIG. 1, of the finished product.

The iron comprises the following main parts: an upper housing or handgrip part 1, a water tank 2 having a top part 3 and a bottom part 4, of which only the top part 3 is visible in FIG. 1, a lower housing part 5 and a sole plate 6. The method concerns the bonding or welding together of the housing/handgrip part 1 and the top and bottom parts 3, 4 of the water tank 2. The cross-sectional view of FIG. 2 shows how these parts are bonded together. The water tank bottom part 4 has a peripheral wall portion 7 with an upper edge 8 and the water tank top part 3 has a peripheral wall portion 9 with a peripheral lower edge 10. The housing/handgrip part 1 has a small strip-shaped portion 11 at both sides, linking a front portion 12 to a rear portion 13 of the housing/handgrip part. This strip-shaped portion is rather flexible. The inner side of the strip-shaped portion is provided with a wall portion 14 having a lower edge 15. The top part 3 of the water tank and the housing/handgrip part 1 are supported by an upper holding device (not shown) in such a way that the lower edge 10 of the water tank top part 4 and the lower edge 15 of the housing/handgrip part 1 are at the same level. The bottom part 4 of the water tank is supported by a lower holding device (not shown). The holding devices are so positioned relative to each other so that the lower edges 10, 15 are opposite the upper edge 8. This requires a correct alignment and movement of the holding devices. A heating platen 16 in the form of a closed metal strip whose shape corresponds to the shape of the peripheral edges 10, 15 is introduced between the opposite edges, and subsequently the holding devices press the edges against the heating platen. The edges melt until a predetermined melting depth is reached. The holding devices open and the heating platen 16 is removed. Next, the holding devices are moved towards each other again, so as to press the opposite edges 8 and 10, 15 against each other for a short period of time, thus allowing the edges to cool down and bond together, as shown in FIG. 3. The water tank parts 3 and 4 are sealed together in a watertight manner. The housing/handgrip part 1 is firmly fixed to the water tank, thereby giving the flexible strip-shaped portion 11 a good rigidity. By means of this method, a simple, good and inexpensive connection between the housing/handgrip part and the water tank is obtained.

What is claimed is:

1. Method of connecting a housing part of an iron to a water tank of the iron, said water tank comprising a top part and a bottom part, and the method including a watertight connection between a peripheral edge of the top part and a peripheral edge of the bottom part of the water tank and a connection between an edge of the housing part and the water tank, characterized in that, the edge of the housing part, the edge of the top part of the water tank and the edge of the bottom part of the water tank are connected to each other in a single process step by means of mirror welding.

* * * * *